US007722427B2

(12) United States Patent
Yamana

(10) Patent No.: US 7,722,427 B2
(45) Date of Patent: May 25, 2010

(54) MOVING TOY UTILIZING MAGNETIC FORCE

(75) Inventor: Tsutomu Yamana, c/o Hajime Corporation 174-I, Higashitsuji, Gose-shi, Nara (JP) 6390025

(73) Assignees: Hajime Corporation, Nara (JP); Tsutomu Yamana, Nara (JP)

( * ) Notice: Subject to any disclaimer, the term of this patent is extended or adjusted under 35 U.S.C. 154(b) by 298 days.

(21) Appl. No.: 11/883,269

(22) PCT Filed: May 24, 2005

(86) PCT No.: PCT/JP2005/009395

§ 371 (c)(1), (2), (4) Date: Jul. 26, 2007

(87) PCT Pub. No.: WO2006/082666

PCT Pub. Date: Aug. 10, 2006

(65) Prior Publication Data

US 2008/0146115 A1 Jun. 19, 2008

(30) Foreign Application Priority Data

Feb. 4, 2005 (JP) ..... 2005-028499

(51) Int. Cl.
*A63H 33/26* (2006.01)
*A63H 33/00* (2006.01)

(52) U.S. Cl. ..... 446/133; 446/137; 104/281

(58) Field of Classification Search ..... 446/129, 446/130, 133, 136, 429; 104/281, 283, 286, 104/282, DIG. 1; 335/306
See application file for complete search history.

(56) References Cited

U.S. PATENT DOCUMENTS 4,486,729 A 12/1984 Lee (Continued)

FOREIGN PATENT DOCUMENTS

JP 53-82558 7/1978

(Continued)

OTHER PUBLICATIONS

Microfilm of the specification and drawings annexed to the request of Japanese Utility Model Application No. 39498/1983 (Laid-open No. 145993/1984) (Takara Co., Ltd.) Sep. 29, 1984, Full text; Figs. 1 to 4 (Family: none).

(Continued)

*Primary Examiner*—Kien T Nguyen
(74) *Attorney, Agent, or Firm*—Jordan and Hamburg LLP

(57) ABSTRACT

A moving toy utilizing a magnetic force movable by itself without exposing the presence of a moving force by using an interaction force by the magnetic force without relying on natural fall so that a user can take more enjoyment by the strangeness and sustaining of its movement. The moving toy comprises a moving toy body (11) having a drive belt (13) on which magnetic poles (12) are disposed at prescribed intervals, a drive means (14), and magnetic poles (15) installed on the outer surfaces of the moving toy body. A moving road surface (16) formed in a channel-shaped gutter-like body in cross section comprises magnetic poles (17) installed on the inside bottom surface thereof at prescribed intervals, and magnetic poles (18) installed on the side parts (161) of the moving road surface at prescribed intervals. The moving toy body (11) is moved by itself since the magnetic poles (12) repel against the magnetic poles (17) in the floated state thereof from the moving road surface (16) by a repulsion between the magnetic poles (15) and the magnetic poles (18) and the magnetic poles (12) are moved by the rotation of the drive belt (13) by the drive means (14). The presence of the moving force when the moving toy body (11) is moved becomes hard to know visually.

4 Claims, 6 Drawing Sheets

U.S. PATENT DOCUMENTS

| | | | | |
|---|---|---|---|---|
| 4,990,117 | A * | 2/1991 | Yonezawa | 446/136 |
| 5,931,714 | A * | 8/1999 | Johnson | 446/129 |
| 6,688,938 | B1 | 2/2004 | Lee | |
| 6,899,036 | B2 * | 5/2005 | Lamb et al. | 104/290 |

FOREIGN PATENT DOCUMENTS

| | | |
|---|---|---|
| JP | 57-48227 | 10/1982 |
| JP | 59-115073 | 7/1984 |
| JP | 3-91398 | 9/1991 |
| JP | 7-27989 | 6/1995 |
| JP | 2003-527154 | 9/2003 |
| JP | 2003-311030 | 11/2003 |

OTHER PUBLICATIONS

Microfilm of the specification and drawings annexed to the request of Japanese Utility Model Application No. 142372/1983 (Laid-open No. 49897/1985) (Sai Yumei), Apr. 8, 1985, Full text; Figs. 1 to 4 (Family: none).

Microfilm of the specification and drawings annexed to the request of Japanese Utility Model Application No. 114483/1988 (Laid-open No. 35788/1990) (NKK Corp.) Mar. 8, 1990, Full text; Figs. 1 to 4 (Family: none).

* cited by examiner

[図2]

[図7]

MOVING TOY UTILIZING MAGNETIC FORCE

TECHNICAL FIELD

The present invention relates to a moving toy that uses a magnetic force as a motion power source.

BACKGROUND ART

In the past, there have been moving toys comprising vehicle wheels that have permanent magnets and that use the attraction of the permanent magnets to move over roads, walls, ceilings, and other surfaces composed of magnetic bodies, as disclosed in Japanese Domestic Republication No. 2003-527154. With this type of moving toy, the wheels are driven by an electric motor or another such drive source, and the toy moves in a movement direction sequentially over points of attraction between the permanent magnets and magnetic bodies on the movement surfaces, and moves using the attraction as a motive force. Toys are also known wherein the repulsion between magnets is used to create levitation, and the toy is moved by the action of gravity, as disclosed in Japanese Laid-open Patent Application No. 2003-311030. This type of moving toy can be played with by moving the toy, which is levitated in an inclined gutter-shaped body, downward along the gutter-shaped body with the aid of gravity; or by pushing or striking with the fingertips the head of the toy levitated in an open box to move the toy vertically.

DISCLOSURE OF THE INVENTION

However, a problem with the automobile toy disclosed in Japanese Domestic Republication No. 2003-527154 is that the toy moves while the wheels comprising the permanent magnets are constantly in contact with and attracted to the movement surfaces, and the motive force caused by the driving of the wheels is clearly apparent, which makes the toy less fascinating and less enjoyable.

Also, a problem with the moving toy disclosed in Japanese Laid-open Patent Application No. 2003-311030 is that although the noncontact action can be fascinating, the toy is not very enjoyable for adults.

The present invention is intended to resolve these problems, and an object thereof is to provide a moving toy utilizing magnetic force, wherein the toy uses interaction force caused by magnetic force instead of naturally falling to move in an unassisted manner, without revealing the existence of the motive force, whereby the fascination and continuation of the movement can provide greater enjoyment.

The present invention for achieving the aforementioned objectives provides a moving toy composed of a moving toy main body and a movement roadway over which the moving toy main body moves using interaction force caused by magnetic force, wherein the moving toy main body comprises magnetic poles (A), a drive belt on which the magnetic poles (A) are disposed at specific intervals, and drive means for rotating the drive belt; the movement roadway comprises magnetic poles (B) for inducing motive force in the moving toy main body by an interaction force based on a magnetic force between the magnetic poles (A); and the magnetic poles (A) that move within the moving toy main body are disposed to be capable of facing the magnetic poles (B) in the movement roadway, and the moving toy main body is moved over the movement roadway by the interaction force between the magnetic poles (A) and (B) that is brought about by the movement of the magnetic poles (A) of the moving toy main body in conjunction with the rotation of the drive belt.

The moving toy main body can further comprise magnetic poles (C) for levitating the moving toy main body above the movement roadway, the movement roadway can further comprise magnetic poles (D) for inducing levitation force in the moving toy main body, and the magnetic poles (C) and the magnetic poles (D) can have the same polarity and repel each other in a facing arrangement, whereby the moving toy main body is constantly levitated at a specific distance from the movement roadway and is capable of moving relative to the movement roadway.

The magnetic poles (C) and the magnetic poles (D) can be configured from either permanent magnets or electromagnetic coils that electrically form magnetic poles.

The magnetic poles (A) and the magnetic poles (B) can be configured from permanent magnets, electromagnetic coils that electrically form magnetic poles, or a magnetizing material.

The present invention also provides a moving toy composed of a moving toy main body and a movement roadway over which the moving toy main body moves using interaction force caused by magnetic force, wherein the moving toy main body comprises magnetic poles (E); the movement roadway comprises magnetic poles (F) for inducing motive force in the moving toy main body by an interaction force based on a magnetic force with the magnetic poles (E); and the magnetic poles (E) are electromagnetically formed by the positions of the magnetic poles (F) relative to the moving toy main body, and the interaction force between the magnetic poles (E) and (F) causes the moving toy main body to move over the movement roadway.

The moving toy main body can further comprise magnetic poles (C) for levitating the moving toy main body above the movement roadway; and the magnetic poles (C) and the magnetic poles (F) have the same polarity and repel each other in a facing arrangement, whereby the moving toy main body is constantly levitated at a specific distance from the movement roadway and is capable of moving relative to the movement roadway.

The magnetic poles (C) and the magnetic poles (F) can be configured from either permanent magnets or electromagnetic coils that electrically form magnetic poles.

According to the present invention, since the moving toy main body is moved by the interaction force brought about by the magnetic force between the magnetic poles (A) on the drive belt of the moving toy main body and the magnetic poles (B) in the movement roadway, it is difficult to visually discern the existence of the motive force when the moving toy main body is moving. A moving toy utilizing magnetic force that is enjoyable and interesting to the user can thereby be obtained by providing an unusual and sustainable movement.

At this time, the moving toy main body levitates at a specific distance from the movement roadway, whereby it is difficult to discern the existence of the motive force when the moving toy main body is moving. A moving toy utilizing magnetic force that is more enjoyable and interesting to the user can thereby be obtained by providing an unusual and sustainable movement.

Furthermore, according to the present invention, since the moving toy main body is moved by the interaction force brought about by the magnetic force between the magnetic poles (F) in the movement roadway and the magnetic poles (E) formed by the electromagnetic coils in the moving toy main body, it is difficult to visually discern the source of the motive force when the moving toy main body is moving. A moving toy utilizing magnetic force that is enjoyable and interesting to the user can thereby be obtained by providing an unusual and sustainable movement.

At this time, the moving toy main body levitates at a specific distance from the movement roadway, whereby it is more difficult to discern the existence of the motive force when the moving toy main body is moving. A moving toy utilizing magnetic force that is more enjoyable and interesting to the user can thereby be obtained by providing an unusual and sustainable movement.

BEST MODE FOR CARRYING OUT THE INVENTION

Figure 1:
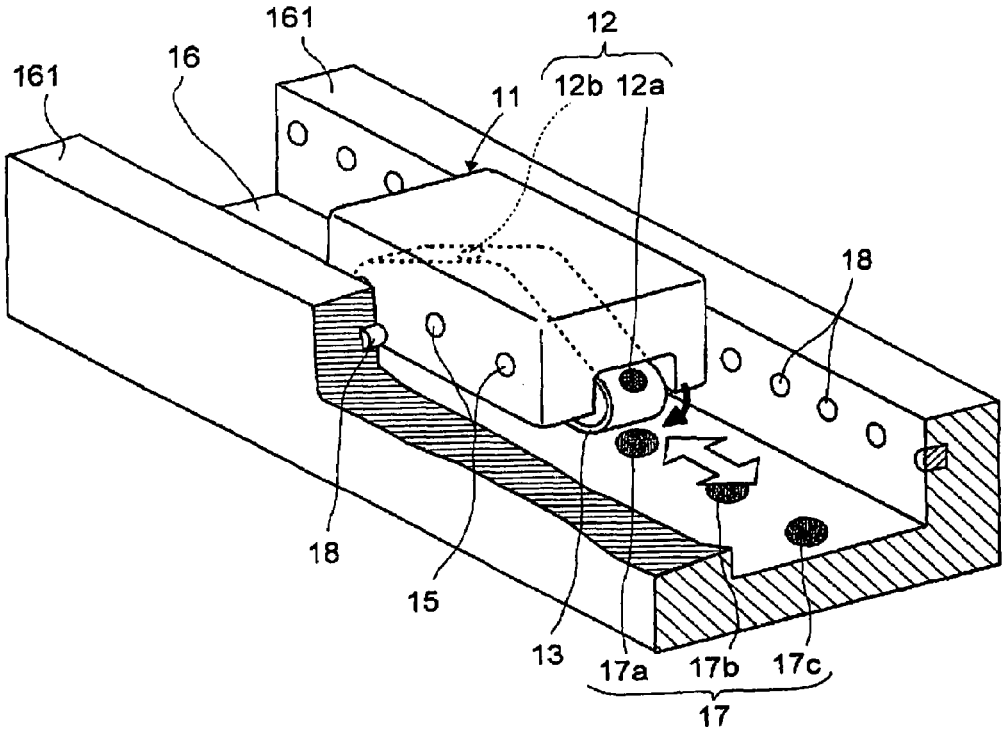
FIG. 1 is a perspective view of a moving toy utilizing magnetic force according to Embodiment 1 of the present invention.
Figure 2A:
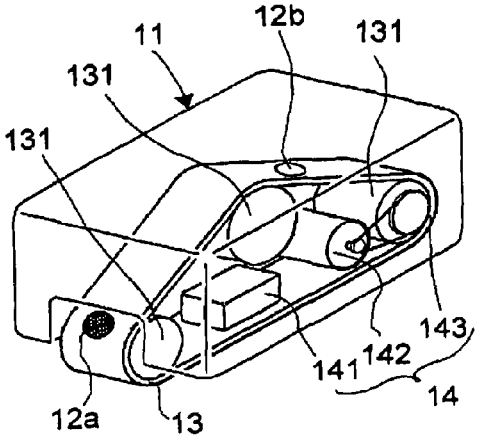
FIG. 2A is a perspective view of the moving toy main body of the same moving toy.
Figure 2B:
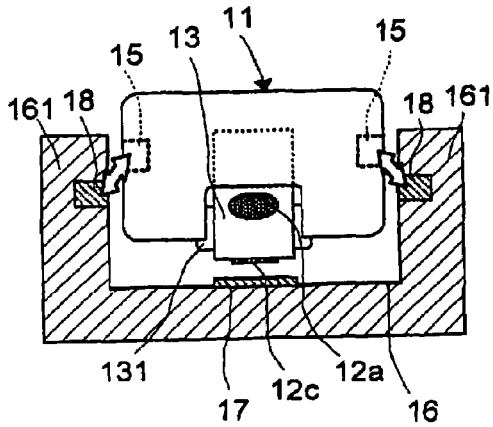
FIG. 2B is a view of the same moving toy as seen from the front in the movement direction.

Embodiments of the present invention are described hereinbelow with reference to the diagrams. FIGS. 1, 2A, and 2B show a moving toy utilizing magnetic force according to Embodiment 1 of the present invention. This moving toy utilizing magnetic force is composed of a moving toy main body 11 and a movement roadway 16 that uses interaction force caused by magnetic force to move the moving toy main body 11 in the direction of the arrow in FIG. 1. The moving toy main body 11 comprises magnetic poles 12 (corresponding to magnetic poles (A)), a drive belt 13 on which the magnetic poles 12 are disposed at specific intervals, drive means 14 for rotating the drive belt 13, and magnetic poles 15 (corresponding to magnetic poles (C)). The magnetic poles 15 are provided to both outer surfaces on the left and right sides in relation to the movement direction of the moving toy main body 11. The movement roadway 16 is a gutter-shaped body that has a U shape in cross section. The movement roadway 16 comprises magnetic poles 17 (corresponding to magnetic poles (B)) provided at specific intervals on the inner bottom surface of the gutter-shaped body, and magnetic poles 18 (corresponding to magnetic poles (D)) provided at specific intervals to the movement roadway sides 161. In the present embodiment, three magnetic poles 12 (12*a*, 12*b*, 12*c*) are provided, but the configuration is not limited to this option alone.

The drive belt 13 of the moving toy main body 11 is rotatably mounted taut on three rollers 131 that are rotatably provided to the moving toy main body 11, as shown in FIG. 2A. The drive means 14 has a drive power source 141, an electric motor 142 rotated by the drive power source 141, and a pulley 143 to which the rotation of the electric motor 142 is transmitted. The pulley 143 is connected to one of the three rollers 131. The electric motor 142 rotatably drives the roller 131 to which the pulley 143 is connected, thereby rotating the drive belt 13.

In the present embodiment, all the four sets of magnetic poles 12, 15, 17, and 18 are made of permanent magnets. The magnetic poles 12, 15, 17, and 18 are arranged so that the poles in one set have the same polarity. The magnetic poles 12 and 17 are oriented so that they repel each other when facing each other, as do the magnetic poles 15 and 18.

The moving toy main body 11 is arranged to fit into the gutter-shape of the movement roadway 16, as shown in FIGS. 1 and 2B. At this time, the magnetic poles 15 and 18 face each other as previously mentioned, and repel each other as shown by the arrows in FIG. 2B. Therefore, a levitation force created is in a direction that lifts the moving toy main body 11 up from the movement roadway 16. The strength of the magnetic poles 15 and 18 is set so as to generate a levitation force sufficient to bring about a noncontact state in which the moving toy main body 11 is kept at a specific distance from the movement roadway 16. The magnetic poles 18 are positioned so as to be in closer proximity to the bottom surface of the gutter-shaped part than the positions of the magnetic poles 15 of the moving toy main body 11 even when a positional relationship is established such as one in which the moving toy main body 11 is pushed down into the gutter-shaped part of the movement roadway 16 and brought into contact with the bottom surface of the gutter-shaped part. The magnetic poles 15 and 18 are thereby designed to constantly generate repulsive force in a direction that lifts the moving toy main body 11 up from the movement roadway 16. These magnetic poles 18 are provided at specific intervals along the movement roadway 16. Therefore, the moving toy main body 11 is always in a levitated state while moving over the movement roadway 16.

As described above, when the moving toy main body 11 is placed in a levitated state over the movement roadway 16, the magnetic poles 12 provided to the drive belt 13 of the moving toy main body 11 and the magnetic poles 17 provided to the movement roadway 16 repel each other. The moving toy main body 11 moves over the movement roadway 16 in either of the directions shown by the arrows in FIG. 1 by using the repulsive force, which is interaction force created by the magnetic force between the magnetic poles 12 and 17. The movement direction changes depending on the drive direction of the drive belt 13. The movement action of the moving toy main body 11 is described in detail hereinbelow.

FIGS. 3A through 3E schematically depict the moving toy main body 11 that is moving over the movement roadway 16, with the movement direction to the right of the diagrams as seen from the side. These diagrams are arranged in a time sequence, in order from FIG. 3A to FIG. 3E. In these diagrams, the magnetic poles 17 provided to the movement roadway 16 include magnetic poles 17*a*, 17*b*, 17*c*, and 17*d*. In the present embodiment, the drive belt 13 rotates clockwise as shown by the black arrows in the diagrams, and the positions of the three magnetic poles 12*a*, 12*b*, and 12*c* in relation to the moving toy main body 11 move with the rotation of the drive belt 13. The magnetic poles 12 and 17 are arranged at equal intervals, and in the present embodiment, the intervals between the magnetic poles 17 are approximately two times the intervals between the magnetic poles 12. The intervals between the magnetic poles 17 and the intervals between the magnetic poles 12 are not limited to this arrangement alone, and may, for example, be set to appropriate experimentally determined intervals to allow the moving toy main body 11 to operate. The intervals are set according to the arrangement of the drive belt 13, the strength of the magnetic poles, the mass of the moving toy main body 11, and other such factors.

Figure 3A:
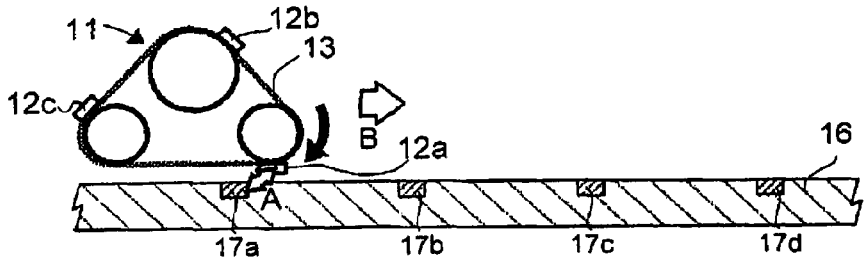
FIG. 3A is a side view for describing the action of the same moving toy.
Figure 3B:
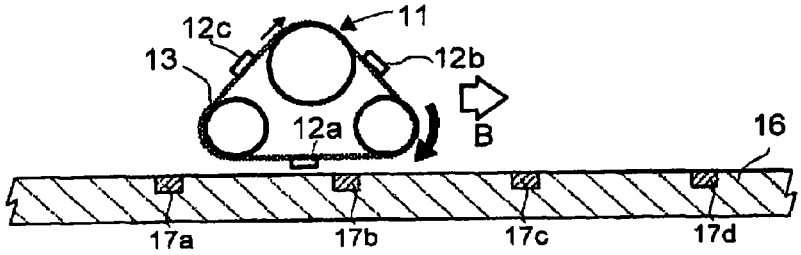
FIG. 3B is a view showing the toy after a specific time has passed in FIG. 3A.
Figure 3C:
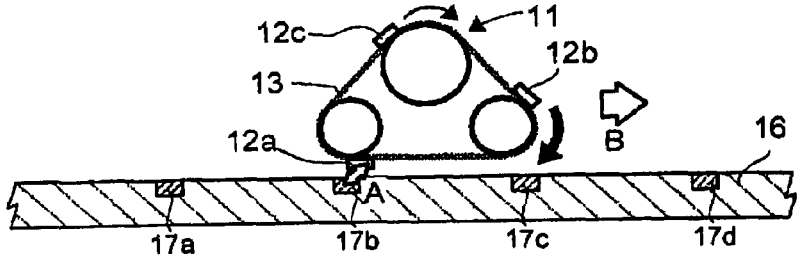
FIG. 3C is a view showing the toy after a specific time has passed in FIG. 3B.

In the present embodiment, as shown in FIG. 3A, repulsive force is created as shown by the arrow A in the diagram in a state in which the positional relationship between the moving toy main body 11 and the movement roadway 16 is such that the magnetic pole 12*a* is in front of the magnetic pole 17*a* in the movement direction. Since this repulsive force is created and the drive belt 13 is rotating, a moving force is induced to move the moving toy main body 11 in the direction of the arrow B in the diagram. At this time, the movement speed of the moving toy main body 11 is kept greater than the rotational speed of the drive belt 13 by the repulsive force between the magnetic pole 12*a* and 17*a*. The moving toy main body 11 begins to move, and the drive belt 13 rotates while the moving toy main body 11 is moving. The moving toy main body 11 and the movement roadway 16 then have a positional relationship in which the magnetic pole 12*a* is mostly no longer affected by the magnetic pole 17*a* in the movement roadway 16, and the magnetic pole 12*a* and magnetic pole 17*b* come into proximity with each other to create repulsive force, as shown in FIG. 3B. As the magnetic pole 12*a* and 17*b* come into proximity with each other, the repulsive force between the magnetic pole 12*a* and 17*b* acts in a direction that reduces the movement speed of the moving toy main body 11, but this force is not strong enough to stop the moving toy main body 11. The magnetic pole 12*a* then moves past the magnetic pole 17*b*, and repulsive force is created in the movement direction of the moving toy main body 11 as shown by the arrow A, whereby the moving toy main body 11 continues to move, as shown in FIG. 3C.

Figure 3D:
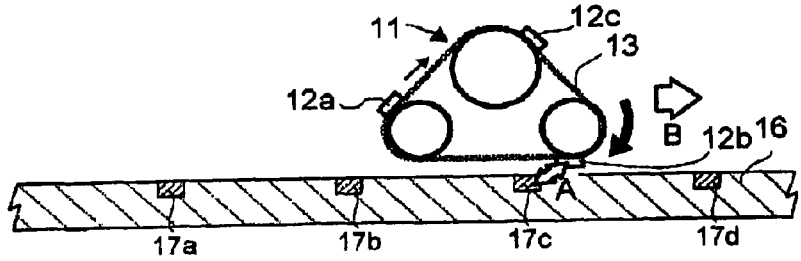
FIG. 3D is a view showing the toy after a specific time has passed in FIG. 3C.
Figure 3E:
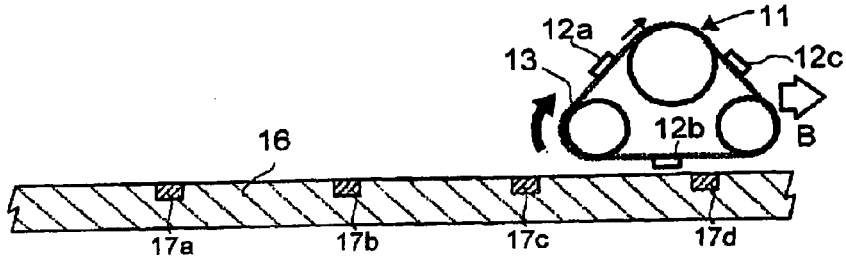
FIG. 3E is a view showing the toy after a specific time has passed in FIG. 3D.
Figure 4:
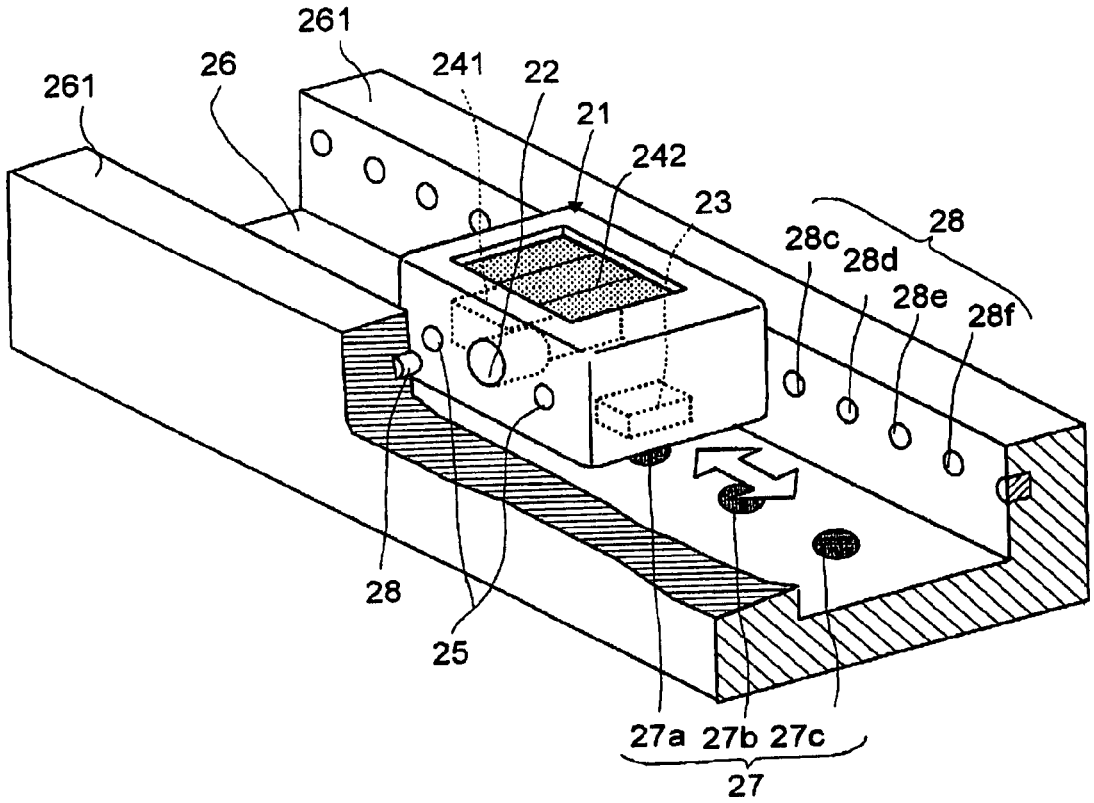
FIG. 4 is a perspective view of a moving toy utilizing magnetic force according to Embodiment 2 of the present invention.

The moving toy main body 11 moves while the drive belt 13 rotates, and the moving toy main body 11 and the movement roadway 16 come into a positional relationship in which the magnetic pole 12*b* is in front of the magnetic pole 17*c* in the movement direction, as shown in FIG. 3D. This positional relationship is similar to the positional relationship between the magnetic pole 12*a* and 17*a* shown in FIG. 3A. At this time, moving force is induced in the same manner as in the above description, and the moving toy main body 11 moves into the state shown in FIG. 3E. The drive belt 13 hereinafter continues to rotate in the same manner as in the operation described above, and the magnetic poles 12*a*, 12*b*, and 12*c* repeatedly create repulsive force in relation to the magnetic poles 17 in the movement roadway 16, whereby the moving toy main body 11 continues to move without assistance over the movement roadway 16.

As described above, since the moving toy main body 11 is moved by the repulsive force between the magnetic poles 12 on the drive belt 13 of the moving toy main body 11 and the magnetic poles 17 in the movement roadway 16, it is difficult to visually discern the moving force when the moving toy main body 11 is moving. At this time, the moving toy main body 11 levitates at a specific distance from the movement roadway 16, making the existence of the motive force even more difficult to discern. A moving toy utilizing magnetic force that is enjoyable and interesting to the user can thereby be obtained by providing an unusual and sustainable movement.

In the present embodiment, all the magnetic poles 12, 15, 17, and 18 are made of permanent magnets, but this option is not limiting. Any or all of these magnetic poles may be configured from electromagnetic coils that electrically generate magnetic poles. Furthermore, either set of the magnetic poles 12 or magnetic poles 17 may be configured from, e.g., iron or another such magnetizable material. This material is then magnetized into magnetic poles by the other set of magnetic poles, and the moving toy main body 11 is moved by the attractive force between the magnetic poles 12 and 17. Another option is, for example, to use electromagnetic coils for either set of magnetic poles, and to configure the moving toy so that the electromagnetic coils can be turned on or off or the strength of the magnetic poles can be adjusted according to the circumstances. It is possible to obtain a moving toy utilizing magnetic force wherein more diverse enjoyment is provided by watching the changes in the behavior of the moving toy main body 11 that accompany the action of the electromagnetic coils. Thus, the magnetic poles 12, 15, 17, and 18 can be given an appropriate configuration in accordance with the various objectives of the toy.

In the present embodiment, various configurations are possible in terms of the orientation and number of magnetic poles, the number of drive belts 13, the shape of the movement roadway 16, and other such factors of the moving toy utilizing magnetic force. By configuring these factors to allow the moving toy main body 11 to move without assistance, a moving toy that is enjoyable and interesting to the user can be obtained by providing an unusual and sustainable movement, similar to the above description. For example, the moving toy main body 11 and the movement roadway 16 may be configured in a manner in which the magnetic poles 12 and 17 are oriented so as to create mutual attractive force. At this time, the drive belt 13 rotates and the magnetic poles 12 and 17 attract each other, making it possible to obtain a moving toy whose moving toy main body 11 moves without assistance. The moving toy may also be configured so that, for example, the moving toy main body 11 has two drive belts 13 in which the magnetic poles 12 provided to each belt are oriented to the left and right sides of the advancing direction, and that the movement roadway 16, which is the gutter-shaped body as described above, has magnetic poles 17 in the movement roadway sides 161. With this type of configuration as well, it is possible to obtain a moving toy that moves without assistance due to the rotation of the drive belts 13 and the generation of interaction force by the magnetic force between the magnetic poles 12 and 17. Furthermore, the magnetic poles 17 in the movement roadway 16 for moving the moving toy main body 11 can be used together with the magnetic poles 18 for levitating the moving toy main body 11. At this time, the positions of the drive belts 13 are set so that interaction force is created by the magnetic force between the magnetic poles 18 and the magnetic poles 12 provided to the rotating drive belts 13, causing the moving toy main body 11 to move, and thereby making it possible to obtain a moving toy.

For example, the moving toy may have a configuration wherein the movement roadway 16 has a single rail-shaped rib provided with magnetic poles 18 above the moving toy main body 11, and the moving toy main body 11 is suspended on the rib of the movement roadway 16 by the levitation force created by the repulsive force between the magnetic poles 15 and magnetic poles 18. The magnetic poles 18 are provided facing towards the sides of the rib. Hanging supports extend into the space above the moving toy main body 11 so as to encircle the magnetic poles 18, and are provided with magnetic poles 15 higher up than the magnetic poles 18 so as to repel the magnetic poles 18. At this time, a drive belt 13 having magnetic poles 12 is provided to the underside of the moving toy main body 11, for example, and interaction force is created by the magnetic force with the magnetic poles 17 of the movement roadway 16 located underneath, whereby the moving toy main body 11 moves without assistance. This type of moving toy utilizing magnetic force may be configured so that the movement roadway 16 does not use magnetic force to suspend the moving toy main body 11, but the hanging supports of the moving toy main body 11 slidably grasp the rail-shaped rib of the movement roadway 16 in the direction of the rail, thereby suspending the moving toy main body 11. At this time, the moving toy main body 11 slides along the rib, making it possible to obtain a moving toy utilizing magnetic force that moves without assistance.

Furthermore, in the present embodiment, the moving toy may be configured without the magnetic poles 15 on the moving toy main body 11 or the magnetic poles 18 in the movement roadway 16. At this time, for example, the moving toy can be configured so that the moving toy main body 11 has wheels for traversing the movement roadway 16 while interaction force is created by the magnetic force between the magnetic poles 12 and 17. It is possible to obtain a fascinating moving toy whose wheels are not driven but which nonetheless moves without assistance over the movement roadway 16. The moving toy may also be configured so that the moving toy main body 11 is made buoyant and is floated in a liquid provided over the movement roadway 16 having magnetic poles 17. At this time, it is possible to obtain a fascinating moving toy that is not propelled through the liquid by a screw or the like, but moves without assistance over the liquid in the movement roadway 16.

FIGS. 4 and 5A through 5C show a moving toy utilizing magnetic force according to Embodiment 2 of the present invention. This moving toy utilizing magnetic force is composed of a moving toy main body 21 and a movement roadway 26 in which interaction force created by magnetic force is used to move the moving toy main body 21 in the direction of the arrow in FIG. 4. The moving toy main body 21 comprises an electromagnetic coil 22 that is provided to one side in the movement direction of the moving toy main body 21 and that electromagnetically generates a magnetic pole (equivalent to the magnetic pole (E)), a magnetic response switch 23 for turning the electric conduction of the electromagnetic coil 22 on and off, a charging unit 241 that serves as a power source for the electromagnetic coil 22, a solar battery 242 that is placed on the top surface of the moving toy main body 21 and that supplies electricity to the charging unit 241, and a plurality of magnetic poles 25 (equivalent to the magnetic poles (C)) provided facing the same poles on the left and right sides in the movement direction of the moving toy main body 21. The movement roadway 26 is a gutter-shaped body having a U shape in cross section, and comprises magnetic poles 27 provided at specific intervals on the inner bottom surface of the gutter-shaped body, and magnetic poles 28 (equivalent to the magnetic poles (F)) provided at specific intervals to the movement roadway sides 261.

All the magnetic poles 25, 27, and 28 are made of permanent magnets. Of these poles, the set of magnetic poles 25 and the set of magnetic poles 28 (28*a*, 28*b*, . . . ) are arranged so that the poles in one set have the same polarity. The magnetic poles 25 and 28 are the same poles and are disposed so as to repel each other in a facing arrangement.

The moving toy main body 21 is arranged to fit into the gutter-shaped part of the movement roadway 26, as shown in the diagram. At this time, since the magnetic poles 25 and 28 face and repel each other, levitation force is created to lift the moving toy main body 21 up from the movement roadway 26, similar to Embodiment 1 described above. The strength of the magnetic poles 25 and 28 is set so as to generate a levitation force sufficient to bring about a noncontact state in which the moving toy main body 21 is kept at a specific distance from the movement roadway 26. The magnetic poles 28 are positioned so as to be in closer proximity to the bottom surface of the gutter-shaped part than the positions of the magnetic poles 25 of the moving toy main body 21 even when a positional relationship is established such as one in which the moving toy main body 21 is pushed down into the gutter-shaped part of the movement roadway 26 and brought into contact with the bottom surface of the gutter-shaped part. Therefore, the magnetic poles 25 and 28 are constantly generating repulsive force in a direction that lifts the moving toy main body 21 up from the movement roadway 26. A plurality of magnetic poles 28 is provided at specific intervals along the movement roadway 26. The moving toy main body 21 is thereby always kept in a levitated state at a specific distance from the movement roadway 16 while moving over the movement roadway. In the present embodiment, the electromagnetic coil 22 does not have a core, and is configured so as not to be attracted to the magnetic poles 28 in the movement roadway 26 while nonconductive.

The magnetic response switch 23 is disposed on the bottom side (the side in proximity to the movement roadway 26) of the moving toy main body 11 so as to securely receive the action of the magnetic force from the magnetic poles 27 in the movement roadway 26 when the moving toy main body 21 is levitating over the movement roadway 26 as described above. The electromagnetic coil 22 and magnetic response switch 23 of the moving toy main body 21 are provided in mutually related positions, as are the magnetic poles 27 and 28 of the movement roadway 26. Specifically, the magnetic response switch 23 energizes the electromagnetic coil 22 in response to the magnetic force of the magnetic poles 27 in the movement roadway 26, and the magnetic poles formed by the electromagnetic coil 22 repel the magnetic poles 28 in the movement roadway 26, whereby the moving toy main body 21 moves over the movement roadway 26 in the direction of either arrow in FIG. 4. The direction in which the moving toy main body 21 moves changes according to the polarity of the magnetic poles formed by the electromagnetic coil 22. The details of the movement of the moving toy main body 21 are described hereinbelow.

Figure 5A:
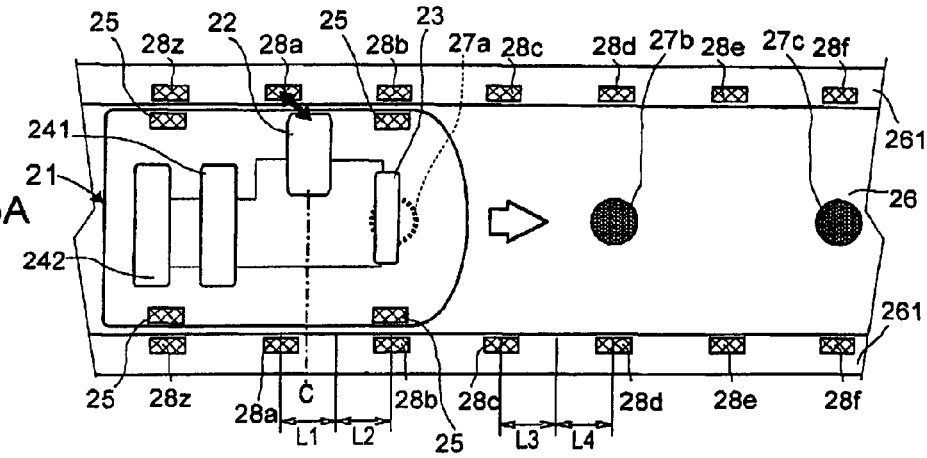
FIG. 5A is a top view for describing the action of the same moving toy.
Figure 5B:
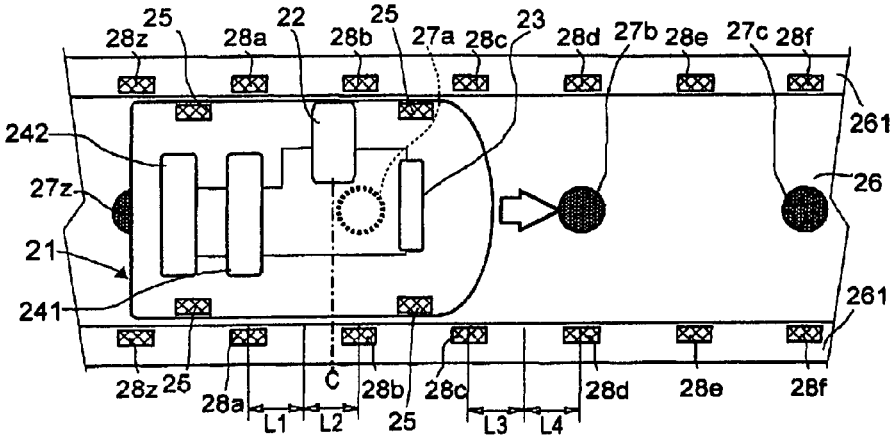
FIG. 5B is a view showing the toy after a specific time has passed in FIG. 5A.
Figure 5C:
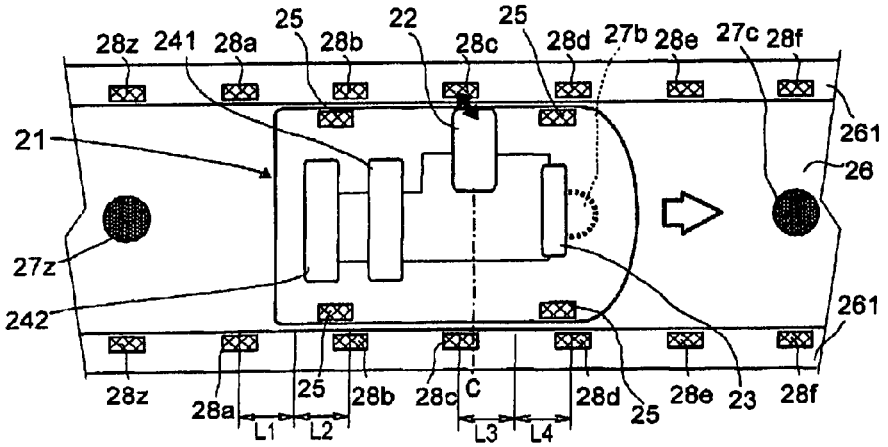
FIG. 5C is a view showing the toy after a specific time has passed in FIG. 5A.

FIGS. 5A through 5C schematically depict the moving toy main body 21 moving over the movement roadway 26, with the movement direction to the right of the diagram as seen from above. These diagrams are arranged in a time sequence from FIG. 5A to FIG. 5C. The magnetic poles 27 provided to the movement roadway 26 are provided according to the alignment of the magnetic poles 28. The magnetic poles 27 and 28 include the magnetic poles 27*a*, 27*b*, 27*c*, 27*z*, and the magnetic poles 28*a*, 28*b*, 28*c*, . . . , 28*f*, 28*z*, respectively. In the present embodiment, the magnetic pole 27*a* is provided in alignment with the magnetic poles 28*b*, the magnetic pole 27*b* is provided in alignment with the magnetic poles 28*d*, and the magnetic pole 27*c* is provided in alignment with the magnetic poles 28*f*.

As shown in FIG. 5A, when the moving toy main body 21 is disposed over the movement roadway 26, and the moving toy main body 21 and movement roadway 26 have a positional relationship in which the magnetic pole 27*a* (shown by the single-dashed line in the diagram) in the movement roadway 26 and the magnetic response switch 23 overlap as seen from above, the magnetic response switch 23 is on in response to the magnetic force of the magnetic pole 27*a*. When the magnetic response switch 23 is on, an electric current from the charging unit 241 is fed to the electromagnetic coil 22, and the magnetic poles formed by the electromagnetic coil 22 repel the magnetic poles 28*a* of the movement roadway 26, as shown by the black arrows in the diagrams. The moving toy main body 21 uses this repulsive force as motive force to move over the movement roadway 26 in the direction of the arrow in the diagrams. Next, as shown in FIG. 5B, when the moving toy main body 21 moves into a range where the magnetic response switch 23 is outside of the effect of the magnetic force of the magnetic pole 27*a*, the magnetic response switch 23 turns off and the electromagnetic coil 22 stops conducting electricity. When the electromagnetic coil 22 stops conducting electricity and the magnetic poles are lost, the moving toy main body 21 continues to move by inertia in the direction of the arrows in the diagrams due to the absence of an external force related to the movement of the moving toy main body 21. When the magnetic response switch 23 of the moving toy main body 21 reaches a position that is subject to the action of the magnetic force of the magnetic pole 27*b* (shown by the single-dashed line in the diagram), the electromagnetic coil 22 again forms magnetic poles as described above, as shown in FIG. 5C. When the electromagnetic coil 22 creates magnetic poles, repulsive force between the magnetic poles of the electromagnetic coil 22 and the magnetic poles 28*c* acts as motive force in the manner shown by the black arrow in the diagram, urging the moving toy main body 21.

In the moving toy main body 21, when the electromagnetic coil 22 and the magnetic response switch 23 are positioned so that the electromagnetic coil 22 shown by the single-dashed line C in the diagram is located in the first (interval L1 in the diagram) of two equal intervals (intervals L1 and L2 in the diagram) between the magnetic poles 28*a* and the magnetic poles 28*b*, the magnetic response switch 23 is disposed in a position in which the electromagnetic coil 22 is energized in response to the magnetic force of the magnetic poles 27.

During the series of actions described above, the electromagnetic coil 2 thereby forms magnetic poles when located in the interval L1 between the magnetic poles 28*a* and 28*b* and in the interval L3 between the magnetic poles 28*c* and 28*d*. Repulsive force that acts as motive force is created between the magnetic poles 28*a* and also between the magnetic poles 28*c*. The moving toy main body 21 is configured so that the electromagnetic coil 2 does not form magnetic poles in the interval L2 or L4 in the diagram, and force acting against the movement direction is not created. The time period during which repulsive force is created is not limited, but the electromagnetic coil 22 should be energized for a specific time period while in the intervals described above. Thus, the magnetic poles 28 and the electric poles of the electromagnetic coil 22 repeatedly create repulsive force in accordance with the movement of the moving toy main body 21, whereby the moving toy main body 21 moves without assistance over the movement roadway 26.

In the present embodiment, the magnetic poles formed by the electromagnetic coil 22 may have a polarity that creates attractive force relative to the magnetic poles 28. This is possible if the positions of the electromagnetic coil 22 and magnetic response switch 23 within the moving toy main body 21 are set so that the interval in which the electromagnetic coil 22 is energized is also the interval in which the attractive force between the magnetic poles of the electromagnetic coil 22 and the magnetic poles 28 constantly acts as a motive force that sustains the movement of the moving toy main body 21. At this time, during the series of actions described above, the electromagnetic coil 22 forms magnetic poles in the intervals L2 and L4 in the diagram, attractive force that acts as motive force is created between the magnetic poles 28*b* and also between the magnetic poles 28*d*, and the moving toy main body 21 moves without assistance over the movement roadway 26.

When the magnetic poles formed by the electromagnetic coil 22 have a polarity that creates repulsive force in relation to the magnetic poles 28, the electromagnetic coil 22 and magnetic response switch 23 in the moving toy main body 21 may be disposed at positions in which the intervals where the electromagnetic coil 22 is energized are the intervals L2 and L4 in the diagram. According to this configuration, the moving toy main body 21 moves without assistance over the movement roadway 26 in the opposite direction in relation to the one described above, and a moving toy can be obtained.

As described above, since the moving toy main body 21 moves under the influence of the interaction force generated by the magnetic force exerted between the magnetic poles 28 of the movement roadway 26 and the magnetic poles formed by the electromagnetic coil 22 of the moving toy main body 21, it is difficult to visually discern the source of the motive force when the moving toy main body is moving. A moving toy utilizing magnetic force that is enjoyable and interesting to the user can thereby be obtained by providing an unusual and sustainable movement. At this time, the moving toy main body 21 levitates at a specific interval from the movement roadway 26, whereby the existence of the motive force when the moving toy main body 21 is moving is more difficult to discern, and it is therefore possible to obtain a more enjoyable moving toy utilizing magnetic force.

In the configuration described above, the magnetic poles 25 and 28 are configured from permanent magnets, but this option is not limiting. Any or all of these magnetic poles may be configured from electromagnetic coils that electrically generate magnetic poles. It is possible to obtain a more enjoyable moving toy by appropriately configuring the magnetic poles 25 and 28 in accordance with the various objectives of the toy. The magnetic response switch 23 of the moving toy main body 21 may also be provided to the side of the moving toy main body 21 so as to be capable of responding to the magnetic force of the magnetic poles 28 in the movement roadway 26. At this time, it is possible to obtain a moving toy utilizing magnetic force in which the movement roadway 26 does not have magnetic poles 27, and the magnetic poles 28 are used both to create levitation force for the moving toy main body 21 and to induce motive force. The number of electromagnetic coils 22 may also be increased, which makes it possible to obtain a more stable motive force.

Figure 6:
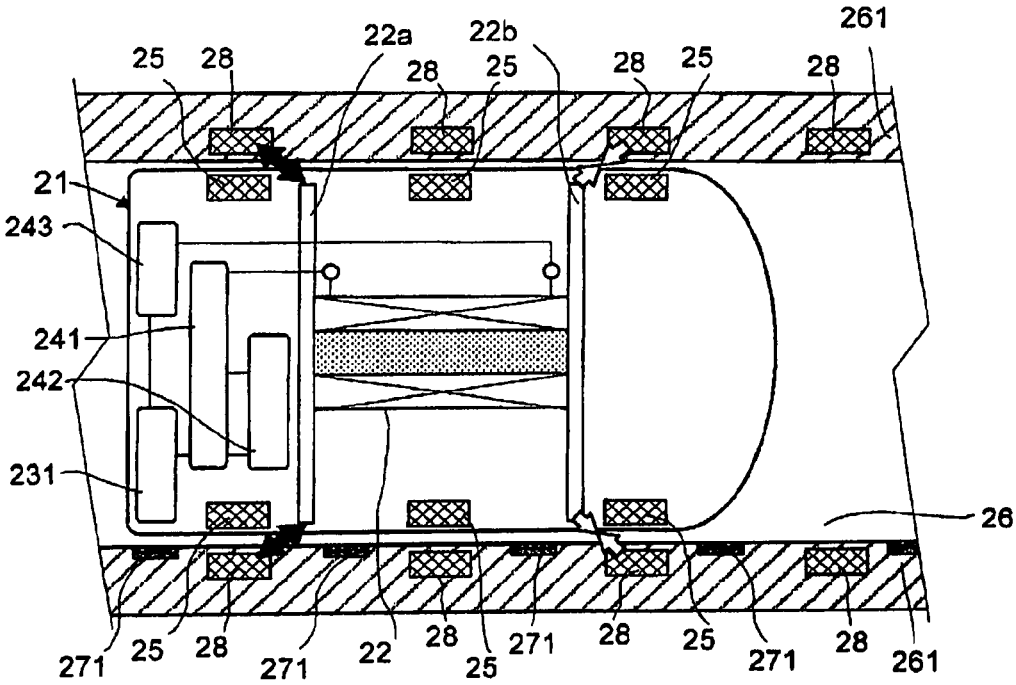
FIG. 6 is a top view of a moving toy utilizing magnetic force according to a modification of the same embodiment.

FIG. 6 shows a moving toy utilizing magnetic force according to a modification of Embodiment 2. Instead of a magnetic response switch 23 for turning the conduction of the electromagnetic coil 22 on and off, this moving toy utilizing magnetic force uses a photosensor 231 for sensing the positions of reflective plates 271 provided to the movement roadway 26, and a switch 243 for turning the electric current on and off on the basis sensing performed by the photosensor 231, and yokes 22*a*, 22*b* are provided to the electromagnetic coil 22. In this moving toy, magnetic poles are formed at the two end portions of the yokes 22*a*, 22*b* by the electrical conduction of the electromagnetic coil 22, and interaction force is created by the magnetic force between these magnetic poles and the magnetic poles 28 of the movement roadway 26. The configurations of the moving toy main body 21 and movement roadway 26 are otherwise the same as in Embodiment 2 described above. In the present modification, the electromagnetic coil 22 is provided with a core and is disposed in the moving toy main body 21 so as to be provided with polarity longitudinally relative to the direction in which the moving toy main body 21 advances. The yokes 22*a*, 22*b* extend so as to be perpendicular to the advancement direction of the moving toy main body 21 as seen from above, wherein the two end portions of the yokes reach the sides of the moving toy main body 21. The centers of the yokes 22*a*, 22*b* are connected to the respective poles of the core of the electromagnetic coil 22.

The action of the moving toy utilizing magnetic force is described hereinbelow. When the photosensor 231 of the moving toy main body 21 and a reflective plate 271 in the movement roadway 26 are in the same position in relation to the advancement direction of the moving toy main body 21, the photosensor 231 senses the reflective plate 271. When the photosensor 231 senses the reflective plate 271, the switch 243 is on, and the electromagnetic coil 22 is thereby energized by the charging unit 241. When the electromagnetic coil 22 is energized, the coil is provided with polarity and excited longitudinally relative to the advancement direction of the moving toy main body 21, forming magnetic poles in the end portions of the yokes 22*a*, 22*b*. The moving toy main body 21 moves to the right of the diagram as a result of the interaction force caused by the magnetic force between the magnetic poles of the yokes 22*a*, 22*b* and the magnetic poles 28 of the movement roadway 26.

The positional relationship between the photosensor 231 and the yokes 22*a*, 22*b* in the moving toy main body 21 is such that when the photosensor 231 senses a reflective plate 271, the moving toy main body 21 is moved to the right of the diagram by the interaction force brought about by the magnetic force created between the magnetic poles 28 and the magnetic poles formed in the two corresponding end portions. In the present modification, when the moving toy main body 21 moves into a positional relationship in which the magnetic poles 28 are in proximity to the rear sides of the two end portions of the yoke 22*a* in the movement direction, magnetic poles are formed at the two end portions of the yoke 22*a*. These magnetic poles create repulsive force in relation to the magnetic poles 28, and this repulsive force acts as motive force for the moving toy main body 21, as shown by the black arrows in the diagram. At this time, the two end portions of the yoke 22*b* are in proximity to the rear sides of the magnetic poles 28 in the movement direction, the magnetic poles formed at the two end portions of the yoke 22*b* create attractive force with the magnetic poles 28, and this attractive force acts as motive force for the moving toy main body 21, as shown by the white arrows in the diagram. In other words, magnetic poles are formed on the yokes 22*a*, 22*b* when the photosensor 231 senses a reflective plate 271, and repulsive force and attractive force are created simultaneously, causing the moving toy main body 21 to move. When the moving toy main body 21 moves and the photosensor 231 senses another reflective plate 271, magnetic poles are again formed on the yokes 22*a*, 22*b*, and interaction force is created by the magnetic force with the magnetic poles 28 in the same manner as described above, thereby urging the moving toy main body 21. The moving toy main body 21 thereby continues to move without assistance. The movement of the moving toy main body 21 in this manner makes it difficult to visually discern the source of the motive force. A moving toy utilizing magnetic force that is enjoyable and interesting to the user can thereby be obtained by providing an unusual and sustainable movement.

In the present modification, the moving toy may be configured so that the magnetic poles formed at the two end portions of the yoke 22*a* create attractive force with the magnetic poles 28, and the magnetic poles formed at the two end portions of the yoke 22*b* create repulsive force with the magnetic poles 28. At this time, the two end portions of the yokes 22*a*, 22*b* are positioned in relation to the magnetic poles 28 so that the attractive force and repulsive force created when the photosensor 231 senses a reflective plate 271 act as motive force for moving the moving toy main body 21. Configuring the moving toy main body 21 and the movement roadway 26 in this manner makes it possible to obtain an enjoyable moving toy utilizing magnetic force that interests people, similar to the above descriptions.

Figure 7:
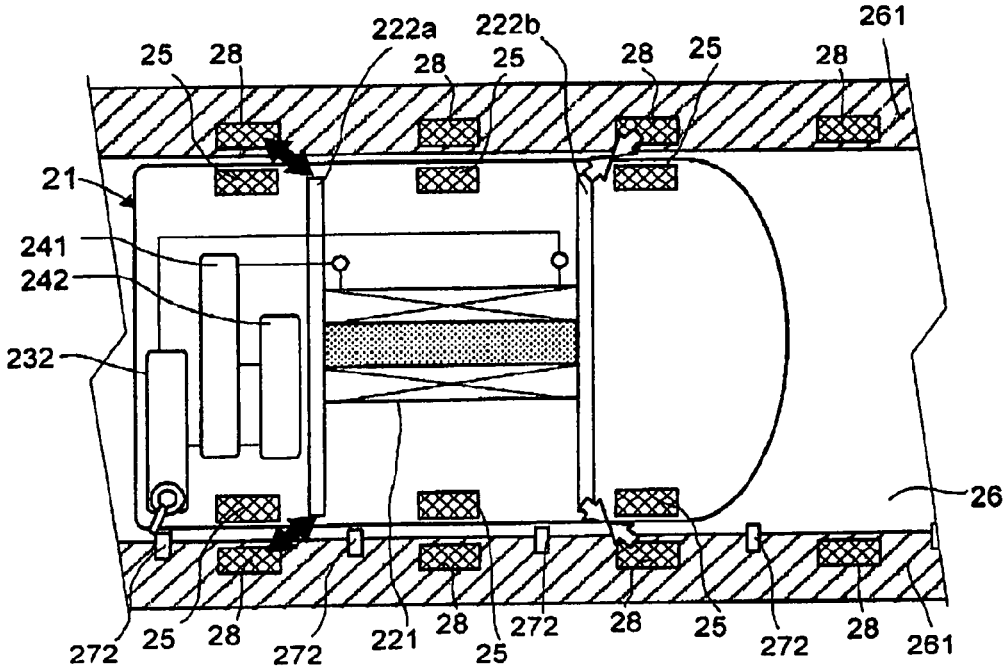
FIG. 7 is a top view of a moving toy utilizing magnetic force and using a mechanical switch according to another modification of the same embodiment.
Figure 8:
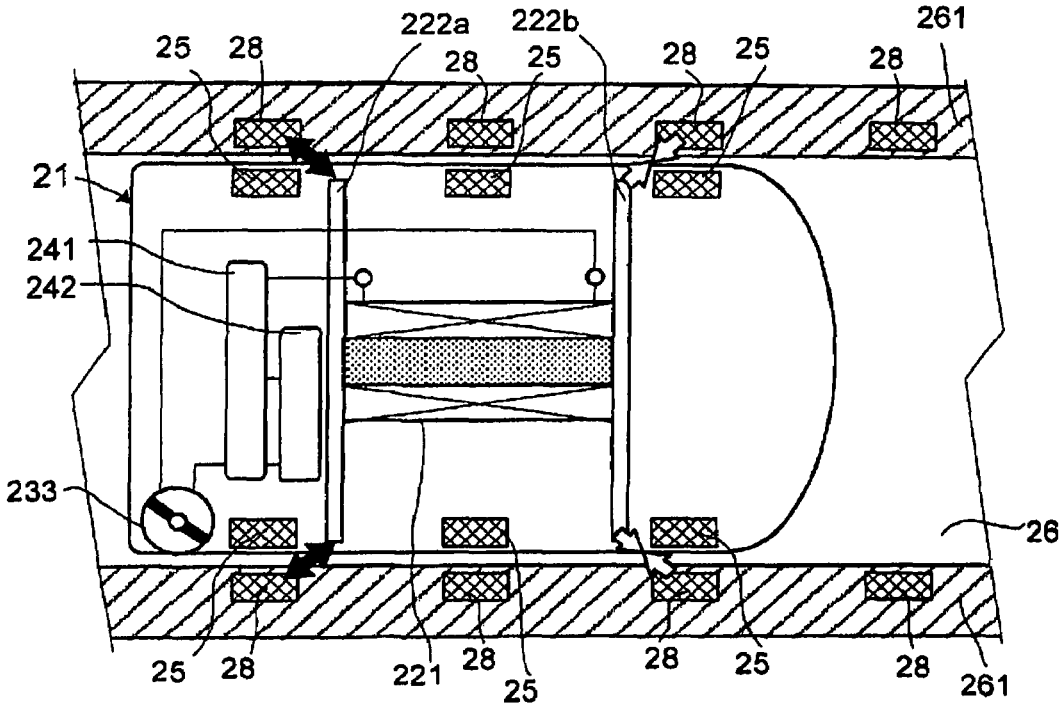
FIG. 8 is a top view of a moving toy utilizing magnetic force and using a rotary switch according to another modification of the same embodiment.

FIGS. 7 and 8 show a moving toy utilizing magnetic force according to another modification of Embodiment 2. In the moving toy utilizing magnetic force according to the modification described above, the switch for turning on and off the electric current through the electromagnetic coil 22 is configured separately from the photosensor 231 and the switch 243. In the moving toy shown in FIG. 7, protrusions 272 are provided in the movement roadway 26 instead of the reflective plates 271, and a mechanical switch 232 is provided to the moving toy main body 21 instead of the photosensor 231 and the switch 243. In this moving toy, the moving toy main body 21 moves and the mechanical switch 232 comes into contact with the protrusions 272, whereby the electric current flowing through the electromagnetic coil 22 is turned on and off. In the moving toy shown in FIG. 8, the movement roadway 26 is provided only with magnetic poles 28 and is devoid of reflective plates 271, protrusions 272, or the like, and the moving toy main body 21 is provided with a rotating switch 233 instead of the photosensor 231 and switch 243. The rotating switch becomes electrically conductive only after having been acted on with a magnetic force and having rotated to a specific position. The rotating switch 233 is capable of responding to the magnetic force of the magnetic poles 28 in the movement roadway 26. In this moving toy, the rotating switch 233 responds to variations in the magnetic force of the magnetic poles 28 in accordance with the movement of the moving toy main body 21, whereby the electric current flowing through the electromagnetic coil 22 turns on and off. The configurations and actions of the moving toy main body 21 and movement roadway 26 are otherwise the same as in the modifications described above. A moving toy utilizing magnetic force that is enjoyable and interesting to the user can be obtained in the same manner as above in cases in which the moving toy main body 21 and the movement roadway 26 are configured in this manner.

The present invention is not limited to the configurations of the embodiments described above, and various modifications can be appropriately made within a range that does not change the scope of the invention. For example, the intervals between the magnetic poles, the intervals and distance over which interaction force is generated by magnetic force between the magnetic poles, the rotational speed of the drive belt 13, the type of power source, and other such factors can be appropriately set so that the action of the moving toy is achieved as intended. For example, a single row of magnetic poles 18, 28 for levitating the moving toy main body 11, 21 was provided to each movement roadway side 161, 261, but two rows may also be disposed in a staggered alignment, for example. It is thereby possible to strengthen the levitation force of the moving toy main body 11, 21 and to stabilize the movement in a noncontact state.

The present application is based on Japanese Patent No. 2005-28499, and the content thereof is therefore incorporated herein by reference to the Specification and Drawings of the aforementioned Patent Application.

The invention claimed is:

1. A moving toy composed of a moving toy main body and a movement roadway over which the moving toy main body moves using interaction force caused by magnetic force; said moving toy utilizing magnetic force characterized in that the moving toy main body comprises magnetic poles (A), a drive belt on which the magnetic poles (A) are disposed at specific intervals, and drive means for rotating the drive belt; the movement roadway comprises magnetic poles (B) for inducing motive force in the moving toy main body by an interaction force based on a magnetic force with the magnetic poles (A); and the magnetic poles (A) that move within the moving toy main body are disposed to be capable of facing the magnetic poles (B) in the movement roadway, and the moving toy main body is moved over the movement roadway by the interaction force between the magnetic poles (A) and (B) that is brought about by the movement of the magnetic poles (A) of the moving toy main body in conjunction with the rotation of the drive belt.

2. The moving toy utilizing magnetic force according to claim 1, characterized in that the moving toy main body further comprises magnetic poles (C) for levitating the moving toy main body above the movement roadway; the movement roadway further comprises magnetic poles (D) for inducing levitation force in the moving toy main body; and the magnetic poles (C) and the magnetic poles (D) have the same polarity and repel each other in a facing arrangement, whereby the moving toy main body is constantly levitated at a specific distance from the movement roadway and is capable of moving relative to the movement roadway.

3. The moving toy utilizing magnetic force according to claim 2, characterized in that the magnetic poles (C) and the magnetic poles (D) are configured from either permanent magnets or electromagnetic coils that electrically form magnetic poles.

4. The moving toy utilizing magnetic force according to claim 1, characterized in that the magnetic poles (A) and the magnetic poles (B) are configured from permanent magnets, electromagnetic coils that electrically form magnetic poles, or a magnetizing material.

* * * * *